United States Patent [19]

Anderson

[11] 4,411,935

[45] Oct. 25, 1983

[54] POWDER FLAME SPRAYING APPARATUS AND METHOD

[76] Inventor: James Y. Anderson, 1838 Cliffhill Dr., Monterey Park, Calif. 91754

[21] Appl. No.: 317,383

[22] Filed: Nov. 2, 1981

[51] Int. Cl.[3] ..... B05D 1/08

[52] U.S. Cl. ..... 427/318; 427/423; 406/127; 406/144; 239/85; 239/654; 239/79; 118/72; 118/47; 118/308

[58] Field of Search ..... 427/423, 318, 225; 406/127, 144; 239/85, 654, 79; 118/72, 308, 302, 47

[56] References Cited

U.S. PATENT DOCUMENTS

| | | | |
|---|---|---|---|
| 2,108,998 | 2/1938 | Schori | 239/85 |
| 2,232,328 | 2/1941 | Klopstock et al. | 118/47 X |
| 3,345,111 | 10/1967 | Bies et al. | 406/144 |
| 3,404,838 | 10/1968 | Hawk | 239/85 |
| 3,504,945 | 4/1970 | Leibundgut et al. | 406/127 |
| 3,986,668 | 10/1976 | Huhne | 239/85 |
| 4,160,048 | 7/1979 | Jaeger | 427/142 |
| 4,317,540 | 3/1982 | Simm | 239/85 |

FOREIGN PATENT DOCUMENTS

| | | | |
|---|---|---|---|
| 569330 | 8/1977 | U.S.S.R. | 118/47 |

*Primary Examiner*—Shrive P. Beck

*Attorney, Agent, or Firm*—Sellers and Brace

[57] ABSTRACT

There is provided an improved powder flame spraying apparatus and method having a preheating nozzle in advance of a plurality of final heating nozzles into the converging flame envelopes of the latter of which hard-facing powder is dispensed. This powder is aspirated into a pressurized stream of inert gas at a variable rate readily adjusted between maximum and no-flow by selectively regulating the gas pressure at and/or spaced downstream from the outlet of the powder aspirator. Regulation of the gas pressure is achieved by venting variable quantities of gas to the atmosphere or air to the aspirator outlet as appropriate to provide a desired powder flow and to achieve a desired volume and velocity of gas and powder delivery into the final heating flames.

35 Claims, 5 Drawing Figures

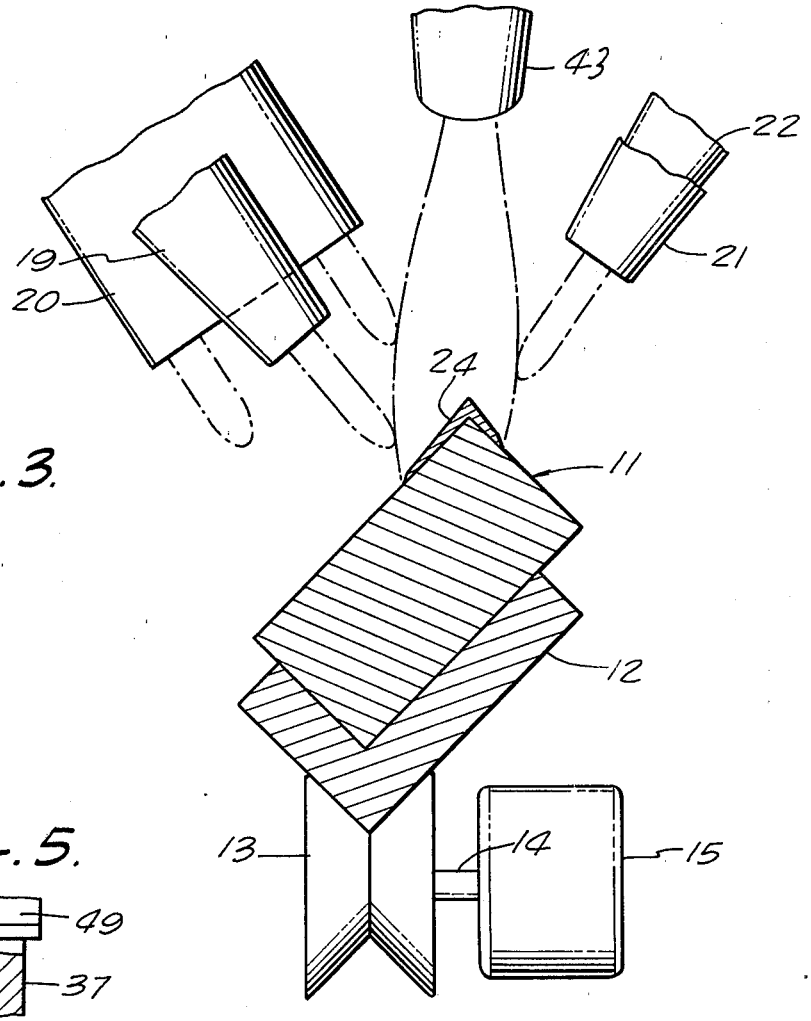
FIG. 3.
FIG. 5.
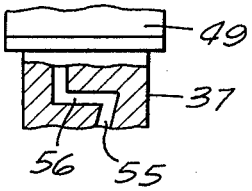
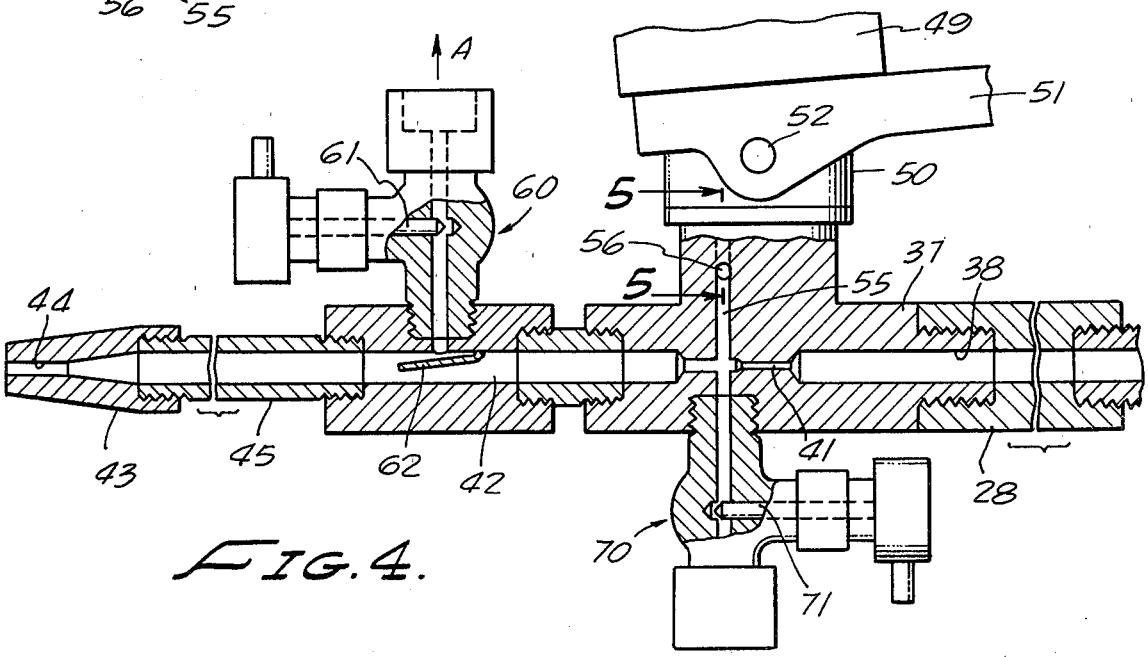
FIG. 4.

POWDER FLAME SPRAYING APPARATUS AND METHOD

This invention relates to apparatus for hardfacing metal, and more particularly to an improved powder flame spraying apparatus and method of increased efficiency and effectiveness and embodying numerous novel features.

BACKGROUND OF THE INVENTION

Powder flame spraying apparatus, and particularly equipment designed to apply a layer of hardfacing to metal, dates back many decades. Designers have evolved many variations of high temperature torch equipment for heating a metal surface to a semi-molten condition and feeding abrasion-resistant metal on to such a surface to form a layer of hardfacing. Prior proposals most pertinent to the present invention are disclosed in U.S. Pat. Nos. to Bleakley 2,233,304; Wett 2,671,689; Cough 2,787,497; Lamb 2,957,630; Shepherd et al 3,111,297; Scape 3,281,078; Cape 3,352,492; Hawk Sr. 3,404,838; Hawk Sr. 3,415,450; Hawk Sr. 3,436,019; Broderick et al 3,620,454; and Broderick et al 3,995,811.

Each of these patents show means for delivering powder from a reservoir by gravity past a manually operated valve for regulating powder flow. In some of these designs the powder flows into a pressurized gas which discharges the powder and gas mixture into the fuel mixture en route to the burner nozzle or nozzles. Such arrangements are shown in Bleakley U.S. Pat. No. 2,233,304; Wett U.S. Pat. No. 2,671,689 and Hawk Sr. U.S. Pat. No. 3,415,450. Others such as Cough U.S. Pat. No. 2,787,497; Cape U.S. Pat. No. 3,352,492; Broderick et al U.S. Pat. Nos. 3,620,454 and 3,995,811 deliver the powder by gravity directly into the flame jets themselves. However, the remainder of the first listed patents disclose torches in which the powder flows by gravity without a conveying gas stream directly into the fuel mixture en route to the torch flame.

Each of these prior powder delivery systems is subject to serious shortcomings and disadvantages because of the inadequate and inefficient means provided for controlling the quantity or rate of powder flow, the flow being dependent on the operator's manipulation of the flow control means and his guesstimate of the amount of powder flowing at any given time as he manually holds the flow control valve open against a valve closing spring. Additionally the rate of powder flow when mixed with fuel flowing to the torch nozzle varies with fuel flow as adjusted by the operator thereby requiring further guesstimate of the powder valve adjustment.

Another serious shortcoming of prior equipment is the lack of any means for pre-heating the metal to be coated in advance of and prior to the delivery of the powder to the preheated area. In consequence, portions of the powder impinge upon areas of the metal not heated to fusion temperature with resulting loss of very expensive powder.

It is well known that all oxy-acetylene torches, or the like, are typically subject to "backfire" from various causes as, for example, reduced fuel line pressure, accidental obstruction of the nozzle outlet, or operating the torch too close to the workpiece. In consequence, the flame propagation recedes back into the fuel passage leading to the nozzle. This usually extinguishes the torch, accompanied by a disturbing sharp report.

If the torch is being used to feed powder in a hardfacing operation wherein the powder flows by gravity into the nozzle mixing chamber, the backfire is not only accompanied by a disturbing report but can cause an explosion extremely hazardous to both the equipment and the operator. This is because the backfire flame can extend into the powder reservoir causing serious increases in pressure, a shut down in operations, the loss of valuable powder, the repair or replacement of damaged components and severe injuries to the operator.

SUMMARY OF THE INVENTION

This invention has been designed to obviate the serious shortcomings and disadvantages of prior powder flame spraying equipment and to provide a greatly improved method and means for applying hardfacing in a foolproof manner under precise control with negligible loss of powder and without harmful results due to backfire. The invention is characterized in particular by its outstanding control of powder deposit, the negligible loss of powder, and the absence of smoke typically present when using prior hardfacing equipment. The hard facing powder is distributed to a plurality of heating torches in a stream of inert gas entirely independently of fuel flow. These torches include a preheating torch and a plurality of converging final heating torches into the flame envelopes of which the unheated powder is conveyed by pressurized inert gas operable to aspirate powder flow at a rate easily and precisely varied between minimum and maximum entirely independently of fuel flow. Preferably powder flow is controlled by either one or conjointly by two adjustable venting devices located in the gas conveying line downstream from the powder aspirator. The gravity powder feed is so arranged as to be dependent upon and governed by the operation of the powder aspirator. The pressure and volume of inert gas entering the aspirator remains substantially constant but the downstream gas pressure can be easily and accurately regulated by venting variable quantities of air into the gas line adjacent the aspirator outlet and/or by venting quantities of gas to the atmosphere downstream from the aspirator thereby to vary the flow rate of powder between maximum and minimum. Adjustment of the powder flow regulators also can vary the volume and velocity of powder-laden gas jetted into the envelopes of the final heater flames.

The use of a preheater in advance of properly adjusted final heating torches provides assurance that the powder is dispensed onto an uncoated area of the workpiece previously brought very substantially toward a metal fusing condition by the preheater torch. Owing to this fact and to the low velocity delivery of powder into the converging flame envelopes of the final heaters, the powder is confined strictly to an area heated to fusion temperature under conditions favorable to the instant fusing of virtually all the hardfacing powder directly to the workpiece upon contact therewith.

Should backfire occur it is confined to the mixing chamber leading to one or more of the several torches and is completely isolated from the powder supply system. Consequently, there is no risk of an explosion or harm to the operator or the equipment. Moreover the system operates without manual manipulation and merely involves the usual adjustment of the fuel supply controls, the opening of the powder cutoff valve and noting whether the previous setting of the two gas venting regulators provide a desired flow of powder suspended in gas flowing in an optimum velocity and volume.

Accordingly, it is a primary object of this invention to provide an improved powder flame spraying apparatus and method for applying hardfacing to metal.

Another object of the invention is the provision of a unique powder flame spraying technique utilizing a plurality of heating flames including both pre-heater and final heater flames and having provision for introducing the hardfacing powder into merging portions of the final heater flames in a stream of non-combustible gas.

Another object of the invention is the provision of improved technique for utilizing a pressurized inert gas to aspirate powder from a supply source and including means for regulating powder flow by regulating the gas pressure on the outlet side of a powder aspirator.

Another object of the invention is the provision of an improved method and apparatus for supplying powder to metal being coated with hardfacing independently of fuel flow to the heating flames for the metal undergoing hardfacing.

Another object of the invention is the provision of an improved apparatus and method of utilizing pressurized gas to supply hard facing powder safely to metal undergoing hardfacing at any desired flow rate without risk of an explosion or hazard to the operator or the equipment.

Another object of the invention is the provision of an improved hardfacing technique and equipment providing a hardfacing deposit of crisp definition free of partially fused powder thereon or adjacent thereto.

Another object of the invention is the provision of means for utilizing inert gas to govern the delivery of powder into an area to be coated with hardfacing and to expedite cooling of the fused deposit.

Another object of the invention is the provision of fluent material feeding equipment operable to control the rate of material flow between maximum and no flow utilizing pressurized gas to aspirate fluent material from a supply source and regulating gas pressure downstream from the aspirator outlet.

Another object of the invention is the provision of pressurized gas to aspirate a flow of hardfacing powder at any of a wide range of flow rates by regulating the admission of gas to the outlet powder aspirator and or regulating the venting of gas to the atmosphere downstream from the powder aspirator outlet.

Another object of the invention is the provision of pressurized inert gas to aspirate flow of powder to flame spraying torch means at a desired rate and to deliver the gas-suspended powder at ambient temperature into the envelope of the torch flame at a readily regulated velocity and in a readily regulated volume.

Another object of the invention is the provision of powder flame spraying apparatus wherein powder flows by gravity toward powder aspirator means via a flow passage effective to interrupt powder flow until and unless the aspirator means is functioning.

Another object of the invention is the provision of powder flame spraying apparatus having gravity responsive powder delivery means provided with a normally closed flow control valve arranged to be held open mechanically until manually released.

Another object of the invention is the provision of powder flame spraying apparatus having powder flow control means including a normally closed cutoff valve in series with powder aspirator means effective to aspirate powder flow at a wide range of flow rates if said cutoff valve is open.

Another object of the invention is the provision of powder flame apparatus having a normally closed on-off powder control valve provided with restraining means to hold it open.

These and other more specific objects will appear upon reading the following specification and claims and upon considering in connection therewith the attached drawing to which they relate.

Referring now to the drawing in which a preferred embodiment of the invention is illustrated:

FIG. 3 is a cross-sectional view on a still larger scale taken along line 3—3 on FIG. 2;

FIG. 4 is a longitudinal cross-sectional view on an enlarged scale taken through the powder feeding subassembly; and FIG. 5 is a fragmentary broken-away view taken along line 5—5 on FIG. 4 showing the dog leg shape of the powder flow passage.

Figure 1:
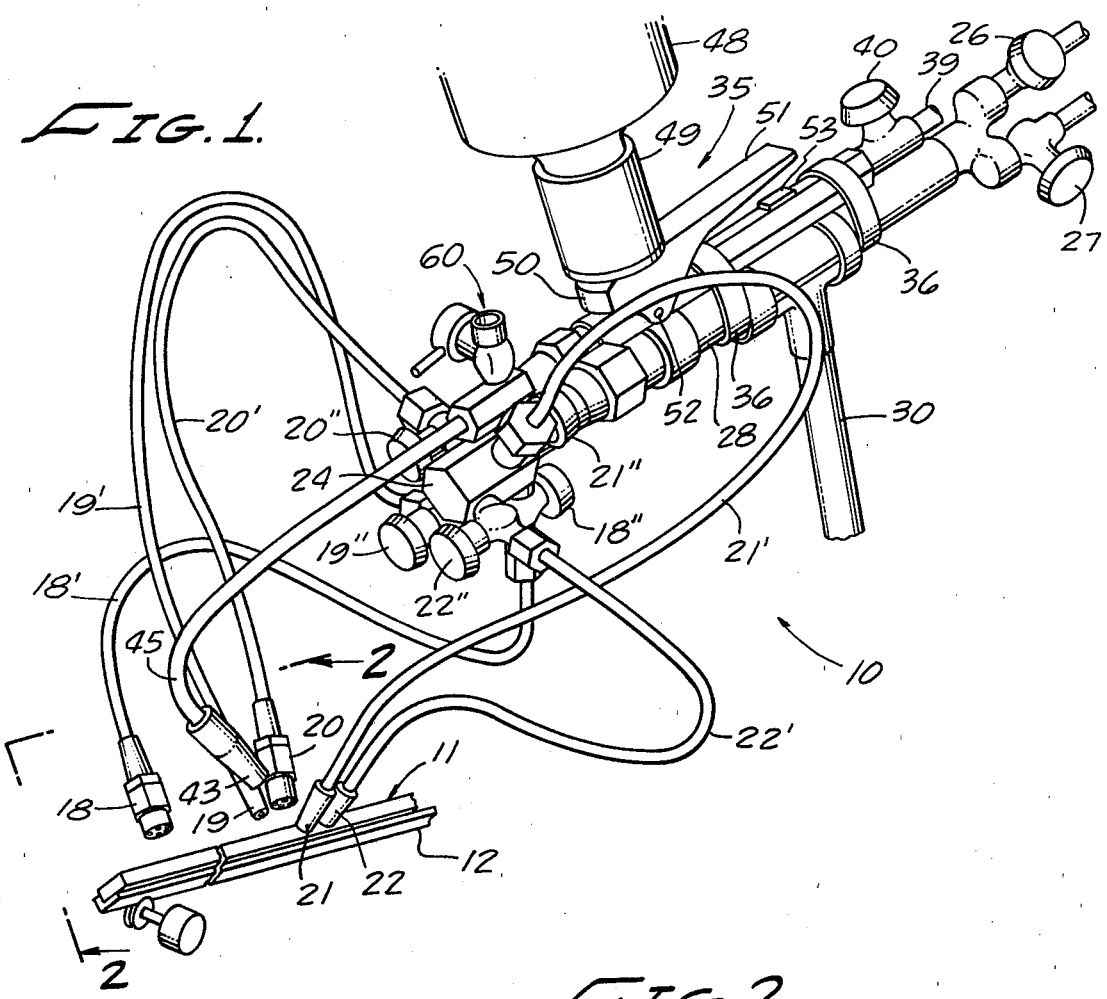
FIG. 1 is a perspective view of the powder flame spraying apparatus usable in practicing the principles of this invention with the various nozzles thereof operatively associated with a workpiece to be hardfaced.

Referring initially and more particularly to FIG. 1, there is shown a typical embodiment of the invention apparatus designated generally 10 in use to hardface the merging surfaces along one corner of a metallic workpiece 11 firmly supported in any suitable conveyor 12. As indicated in FIG. 3, conveyor 12 is supported on a plurality of grooved rollers 13 mounted on a respective shaft 14 and driven in unison by a motor 15.

Workpiece 11 is heated by a plurality of torches including a preheater torch 18 and a group of final heater torches 19, 20, 21 and 22 here shown as arranged in two pairs with the torches of each pair converging toward the area previously heated by preheater torch 18. Each of these torches is connected to the fuel distributing manifold 24 by ductile tubing 18', 19', 20', 21', and 22' through a respective flow control valve 18", 19", 20", 21" and 22". The ductile tubing provides convenient means for manipulating the tubing and the associated torch into the optimum heating position with respect to the area of the workpiece to be coated with hardfacing. As herein shown for illustrative purposes, the strip of hardfacing 24 (FIG. 3) is applied astride one corner of the iron workpiece 11 with the wider portion thereof on the upper wider face of the rectangular workpiece. For this reason I find it is expedient to direct the preheater torch flame generally against this face of the workpiece with a portion of the flame impinging on the other face to be coated with the hardfacing. However, it will be understood that the ductile tubing supporting the preheater nozzle facilitates positioning of the preheater as found most advantageous and to provide optimum results attained when the area to be hardfaced is heated partially to powder fusing temperature before being further heated by the final heating torches 19 to 22.

Each of the torches is supplied with suitable fuel, such as oxygen and acetylene, through respective valve control supply lines 26 and 27 leading into a mixing chamber 28 and manifold 24. This entire assembly is rigidly supported in any suitable manner as by a strut or pedastal 30.

The powder feeding and control subassembly designated generally 35 is shown in its essential details in FIG. 4. This subassembly is secured to the mixing chamber 28 for the heating torches by a pair of clamps 36 embracing the main body 37 of subassembly 35. As shown in FIG. 4, the main body 37 is formed of a plurality of fittings threaded to one another in end-to-end alignment to form an inert gas-conveying passage 38 connected by pipe 39 (FIG. 1) to a source of pressurized gas such as, carbon dioxide, nitrogen, helium, or the like controlled by a cutoff valve 40. Gas passage 38 includes a venturi having a throat 41 the outlet of which discharges into a gas and powder mixing chamber 42 and a ductile tube 45 terminating in a nozzle 43 having a discharge orifice 44. The ductile tubing 45 enables nozzle 44 to be positioned wherever most effective in discharging powder at ambient temperature into the envelopes of the final heating torches 19 to 22 as will be described more fully presently.

Referring more particularly to FIGS. 1 and 4, it will be observed that the hardfacing is stored in a container or reservoir 48 discharging by gravity into a supporting cup 49 for the container attached to the inlet of a powder cutoff valve such as a well known powder pinch off valve 50 normally spring biased to closed position. This valve is movable to open position by an operating handle 51 pivoted to main body 37 by a pin 52. This handle is preferably of magnetic material and is held firmly in open position when pivoted into contact with a permanent magnet 53 (FIG. 1) secured to the main body 37 adjacent the outer end of handle 51.

Powder falling by gravity through valve 50 passes downwardly through passage 55 which includes a horizontally disposed dog leg 56 (FIG. 4) and an outlet positioned closely adjacent the outlet end of the venturi throat 41. As is best shown in FIG. 5, the dog leg 56 is sufficiently long to prevent powder flow into the gas and powder mixing passage 42 unless aspirated thereinto by gas discharging from venturi throat 41. If it is, the venturi throat is effective to aspirate a flow of powder through the dog leg and the full length of powder passage 55.

The rate of powder flow is widely variable depending on pressure and gas velocity conditions prevailing in mixing chamber 42, at the outlet of venturi 41 or at both locations as will be explained. The volume and velocity of gas issuing from nozzle 43 and the quantity of powder carried therein is dependent upon the adjustment and functioning of either or both of two venting devices 60 and 70, each having one end in communication with mixing chamber 42 and the other end in communication with the atmosphere. As herein shown by way of example, both venting devices 60 and 70 are provided with a respective precision needle valve 61, 71 manually manipulatable to control the flow of gas therepast. Venting device 60 is in communication with mixing chamber 42 appreciably downstream from the outlet of the venturi throat 41 and its inlet is shrouded by a deflector 62 positioned to prevent the entrance of powder thereinto when its needle valve is opened. In this connection, it will be understood and recognized that there is always a superatmospheric pressure condition existing throughout the major length of mixing chamber 42 excepting only the portion thereof surrounding the outlet of the venturi throat 41. Accordingly, if needle valve 61 is open during the operation of the powder delivery system, valve 60 will be effective to vent pressurized gas to the atmosphere as indicated by arrow A in an amount dependent upon the open adjustment of the needle valve. During such venting, deflector 62 will be effective to divert the fast-flowing relatively heavy power away from the inlet to valve 60 with the result that only gas is vented to the atmosphere.

Venting device 70, as here shown, is identical with venting device 60 and opens into mixing chamber 42 in alignment with the powder supply passage 56 and closely adjacent the outlet of the venturi throat 41. Accordingly, if venting valve 71 is open, the aspirating action provided by venturi throat 41 is effective to aspirate atmospheric air into passage 42 and minimize or attenuate the semi-vacuum condition produced by the venturi throat. It will therefore be appreciated that needle valve 71 provides a very fine and accurate means for regulating the flow of powder produced by the sub-atmospheric condition produced by the flow of inert gas through venturi throat 41. Moreover this wide range control of powder flow is achieved by the admission of a very small amount of atmospheric air. For example, the quantity of powder flow can be controlled between maximum and zero flow by regulating the entry of a relatively insignificant amount of air into chamber 42 in the area adjacent the outlet of venturi 41.

OPERATION

The operation of my hardfacing apparatus will now be described in one of many typical modes of use with the various nozzles adjusted to apply a continuous strip of hardfacing 75 of varying thickness transversely thereof along one merging pair of corner faces of an elongated workpiece 11 supported in the conveyor-driven fixture 12. FIGS. 1 and 3 show the workpiece 11 supported lengthwise of the path of conveyor travel with the corner to be coated uppermost and midway between the pairs of final heater nozzles 19 to 22 and generally directly beneath the powder delivery nozzle 43.

Figure 2:
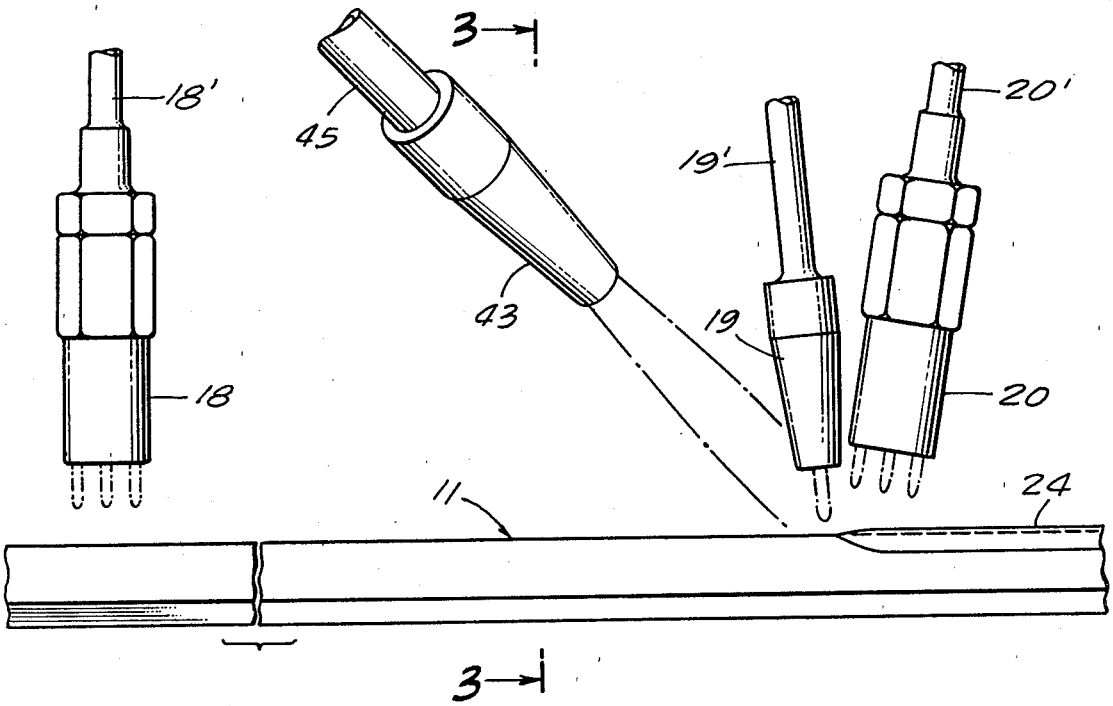
FIG. 2 is a fragmentary view on an enlarged scale taken along the broken line 2—2 on FIG. 1.

Before starting this conveyor motor 15 to advance the workpiece to the right as indicated by arrow C in FIG. 1, the operator makes certain a charge of powder is present in container 48 seated in the powder feed socket 49 and then turns on the valves 26, 27 controlling the supply of oxygen and acetylene to the torch assembly 10. The operator then opens the flow control valves 18'', 19'', 20'', 21'' and 22'' to each of the burner nozzles 18 to 22 as well as the oxyacetylene supply valves 26, 27 and ignites the flames at each of the torches. The various valves are then adjusted to provide the precise flame envelopes at each of the preheater and final heater nozzles necessary to heat the the area of the workpiece in the path of the powder dispensed from nozzle 43 to a semi-molten condition. Excellent results are achieved in applying the strip of hardfacing 24 (FIG. 4) to a steel workpiece 11 by using heater 18 to preheat the workpiece to 900° F. and by using heaters 19 to 22 to increase the temperature to about 2000° F. as the powder impinges thereon. FIGS. 2 and 3 do not illustrate the flame envelopes but indicate by dot and dash lines the general size and position of the various flame cones relative to the surface undergoing heating thereby. As is well known by persons skilled in this art, the nature and position of the flame cones is highly significant and important.

The torch flames having been appropriately adjusted for optimum heating effectiveness, the operator opens valve 40 controlling the flow of pressurized inert gas into the powder delivering subassembly 35. Typically, this gas flows past valve 40 at a pressure substantially lower than that existing in the fuel delivery passages and typically at a pressure in the range of 5 to 6 psi. The venturi throat 41 of the powder aspirator in cooperation with the size of nozzle orifice 44 very substantially reduces the inert gas pressure to a value typically lying between 1 and 1.5 psi where the orifice 44 of nozzle 43 has a diameter of 0.042. However, at this time no powder can flow because the powder cutoff valve 50 is normally closed by spring means not shown.

The apparatus is now in readiness to apply hardfacing to workpiece 11 as soon as the operator opens powder valve 50 and supplies the power to the workpiece conveyor to advance the workpiece to the right as viewed in FIG. 1, as is indicated by arrow C in FIG. 1. The operator initiates powder flow by depressing cutoff valve lever 51 to open this valve which is retained in open position by magnet 53 (FIG. 1). Powder then flows by gravity from the reservoir through passage 55 into the horizontally disposed dog leg 55 from which the powder is aspirated by the gas issuing from the aspirator and venturi orifice 41.

If the needle valves of the two venting valves 60 and 70 are closed, the powder is aspirated at a maximum rate and dispensed from nozzle 43 directly into the merging and converging envelopes of the flames issuing from the final heater nozzles 19 to 22. This powder is quickly heated to a molten condition while entrapped and within the converging envelopes of the final heater flames and is carried thereby directly against the semi-moltened or fused area of the workpiece underlying the final heater nozzles. These flame envelopes not only quickly heat the powder to fusion temperature but they trap it and confine it while aiding in propelling it against the fluent surface of the workpiece. The deposit is quickly cooled to a non-flowing condition by the inert gas used to convey the powder. Furthermore and of particular importance, the deposit of hardfacing is thickest in the area lying midway between the converging final heaters 19 to 22 and here shown as embracing the corner of the workpiece and thins to the crisply and sharply defined opposite lateral feather edges of the strip of hardfacing. This crisp edge is primarily the result of the powder-confining action of the final heater flames and the temperature control achieved by the proper adjustment and positioning of these flames. The edges of the powder deposit lie within the remote sides of the preheater flame envelopes with the result that substantially 100% of the powder is fused to the workpiece and essentially distributed and confined within the areas indicated by the hardfacing layer 24 illustrated in FIG. 3.

If the operator wishes to vary the volume of inert gas flow, the velocity of this jet issuing from nozzle 43, or the quantity of powder issuing from this nozzle, he makes appropriate adjustment of the needle valves of one or both of the venting devices 60 or 70.

Let it be assumed that he wishes to vary the volume and velocity of the gas issuing from nozzle 43. This is accomplished by adjusting the handle of needle valve 61 to vent some of the gas from chamber 42 to the atmosphere. Deflector baffle 62 prevents powder from escaping to the atmosphere through venting device 60 but does permit the desired amount of gas to escape thereby adjusting both the volume and velocity of the inert gas en route to the powder dispensing nozzle 43.

If the operator wishes to reduce the quantity of powder delivered to the workpiece, he adjusts needle valve 71 to an appropriate open position thereby permitting a small amount of atmospheric air to bleed into the subatmospheric pressure condition prevailing at the outlet end of the aspirator orifice 41. Only a very small amount of air introduced at this point suffices to reduce the semi-vacuum condition existing at this outlet and this reduces the effectiveness of the aspirator to aspirate powder along the dog leg 56 of passage 55.

It will therefore be appreciated that venting device 70 operates as an extremely sensitive and accurate means for varying the quantity and rate of powder delivered to the powder dispensing nozzle 43. If the subatmospheric pressure condition is cancelled at the outlet end of aspirator throat or orifice 41, no powder will be aspirated even though the cutoff valve 50 remains fully open. This is because dog leg 56 lies in a generally horizontal plane with the result that no flow will occur in the absence of suction provided by the aspirating venturi orifice 41.

Accordingly, venting device 70 functions to regulate powder flow from no flow to maximum flow so long as the cutoff valve 50 is held open and pressurized gas is supplied to the aspirator at a uniform rate and pressure, such as 5 to 6 psi. The adjustment of venting device 70 has a negligible effect on the pressure and flow rate of gas in passage 42. However, the adjustment of needle valve 61 in venting device 60 is effective to vary the superatmospheric pressure in passage 42 materially in a range of 1 to 1.5 psi. This change does regulate the flow of powder particularly in the range between maximum flow and about one half of maximum and has a very substantial effect on adjusting the volume and velocity of the jet issuing from powder nozzle 43.

It will be recognized that the operator can adjust the needle valves of either or both of the venting devices 60 and 70 to achieve an extremely wide range of operating results as respects the delivery of powder delivered into and entrained against the semi-moltened surface of the workpiece by the converging group of flames issuing from final heater nozzles 19 to 22.

As will be appreciated from the foregoing description of the rigid support for the several torches relative to the workpiece on the conveyor 12, it is unlikely that any backfire will occur. However, if it should, it is confined to the passages supplying fuel to one or more of the torch nozzles. Hence the backfire is completely isolated from the powder-dispensing nozzle and its supply conduit 45 with the result that there is no possibility of an explosion occurring in the powder dispensing subassembly 35.

If the operator wishes to discontinue powder supply without cutting off the flow of inert gas or changing the adjustment of either of the venting devices 60 or 70, he merely lifts handle 51 of cutoff valve 50 from magnet 53 thereby closing the powder cutoff valve. This is highly desirable and a great convenience when adjusting any of the fuel control valves or the position of any of the nozzles relative to the workpiece. Cutoff of the entire apparatus is simply accomplished by closing the inert gas valve 40 and each of the fuel vlaves 26 and 27 thereby leaving all other valves in their previous preset condition. Operation of the flame spraying device is then resumed in a very simple and expeditious manner by simply reopening gas valve 40 and the two fuel valves 26 and 27 to a preselected normal operating position.

The expression "hard facing" as used in the foregoing description and in the claims will be understood as generic to powder metal flame spraying operations generally, and as including powdered metal compositions suitable for forming a layer to resist erosion and abrasion as well as those powdered metal compositions forming a layer to resist corrosion and attack of the underlying base metal by hostile fluids. Such a protective layer or coating may cover the entire surface of the base metal or only the area in need of protection.

While the particular improved powder flame spraying apparatus and mechanism herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. Powder flame spraying apparatus for applying hard facing directly to uncoated metal comprising:

torch means having at least three burner nozzles including a preheater nozzle operable to preheat the surface of metal to be hardfaced to approximately 900° F. and at least a pair of final heater nozzles having their tips converging toward one another and against an area of uncoated metal to be hard faced closely downstream from said preheater nozzle;

means for moving the metal undergoing hardfacing and said torch means relative to one another to advance the area heated by said final heater nozzles toward the area heated by said preheater nozzle along substantially the shortest path therebetween;

means for supplying a combustible mixture to each of said nozzles; and means for jetting hardfacing powder at ambient temperature between converging portions of the flame envelopes formed by said final heater nozzles and thence against an area of the metal previously preheated by said preheater nozzle and then undergoing further heating by said final heater nozzles.

2. Powder flame spraying apparatus as defined in claim 1 characterized in that said final heater nozzles are constructed and arranged to provide jets of flame converging toward one another and against an area of the metal already preheated by said preheater nozzle, and said powder jetting means being positioned to jet powder into the merging envelopes of the flame jets from said final heater nozzles.

3. Powder flame spraying apparatus as defined in claim 1 characterized in the provision of means for readily adjusting said nozzles relative to one another and the metal surface to be hardfaced.

4. Powder flame spraying apparatus as defined in claim 1 characterized in the provision of means for conveying hardfacing powder from a powder reservoir to said powder jetting means in pressurized inert gas.

5. Powder flame spraying apparatus as defined in claim 4, characterized in the provision of powder aspirating means in said gas conveying means operable to aspirate powder from said powder reservoir into said conveying means, and said powder conveying means including an unobstructed passage constructed and arranged to block powder flow when said aspirating means is inoperative and operable to permit powder flow when there is a powder aspirating flow of gas through said powder aspirating means.

6. Powder flame spraying apparatus as defined in claim 5 characterized in the provision of powder aspirating means in said gas conveying means, regulatable atmospheric venting means opening into said gas converging means on the downstream end of said powder aspirating means operable to vary the flow of powder into said inert gas.

7. Powder flame spraying apparatus as defined in claim 6 characterized in that said gas venting means opens into said gas conveying means closely adjacent the downstream end of said powder aspirating means.

8. Powder flame spraying apparatus as defined in claim 6 characterized in that said gas venting means opens into said gas conveying means in an area of approximately minimum pressure at the downstream end of said powder aspirating means.

9. Powder flame spraying apparatus as defined in claim 6 characterized in that said gas venting means opens into gas conveying means adjacent the downstream end of said powder aspirating means.

10. Powder flame spraying apparatus as defined in claim 6 characterized in the provision of a second regulatable atmospheric gas venting means opening into said gas conveying means at a point spaced between first mentioned gas venting means and powder jetting means and operable to vent gas to the atmosphere.

11. Powder flame spraying apparatus as defined in claim 6 characterized in that said first gas venting means is operable to vent air into said gas conveying means and is thereby primarily operable to vary the rate of powder flow to said nozzle means, and said second gas venting means being primarily operable to vent gas to the atmosphere thereby to vary the velocity and volume of gas discharged by said powder jetting means.

12. Powder flame spraying apparatus as defined in claim 1 characterized in that said means for supplying a combustible mixture to said burner nozzles and said powder jetting means are adjustable to vary the spacing and disposition of said burner nozzles and said powder jetting means relative to one another and relative to the metal to be hardfaced.

13. Powder flame spraying apparatus as defined in claim 1 characterized in that said burner nozzles are so constructed and arranged so to fuse a strip of hardfacing powder to said uncoated metal in a strip of maximum thickness in the transverse midsection thereof and which strip of hardfacing feathers to minimum thickness at the opposite lateral edges thereof.

14. Powder flame spraying apparatus having in combination:

torch means for heating uncoated metal to be coated with hardfacing powder:

a powder reservoir;

pressurized inert gas means for aspirating and conveying powder from said powder reservoir and dispensing said hardfacing powder and the conveying gas therefor into the flame of said torch means through powder and inert gas dispensing means; and powder flow control means for controlling the quantity of powder flow including means for venting to the atmosphere variable quantities of said pressurized gas from a point between said powder aspirating means and said powder dispensing means.

15. Powder flame spraying apparatus as defined in claim 14 characterized in that said gas venting means is operable to regulate the gas pressure between said powder aspirating means and said powder dispensing means in a range of about 1.0 psi and 1.5 psi.

16. Powder flame spraying apparatus as defined in claim 14 characterized in that said powder flow control means is operable to regulate the flow of powder between zero and maximum flow with minimal, if any, variation in the total flow of said pressurized powder conveying gas.

17. Powder flame spraying apparatus as defined in claim 14 characterized in that said powder flow control means includes valve means in an atmospheric vent opening into a superatmospheric pressurized portion of said powder conveying means downstream from said aspirating means and manually adjustable to accurately regulate the gas pressure between said powder aspirating means and said powder dispensing means.

18. Powder flame spraying apparatus as defined in claim 14 characterized in that said powder aspirating means includes a gravity powder flow passage in communication with said powder reservoir which flow passage includes a short non-gravity section effective to block powder flow except in response to the operation of said powder aspirating means.

19. Powder flame spraying apparatus as defined in claim 18 characterized in that said means for regulating the pressure of said powder conveying gas between said aspirating means and said dispensing means includes needle valve controlled means for venting some of said pressurized fluid to the atmosphere thereby to vary the flow of powder dispensed from said powder dispensing means.

20. Powder flame spraying apparatus as defined in claim 18 characterized in that said means for regulating said gas pressure is operable to vent atmospheric air into said gas conveying means in and closely adjacent the downstream end of said powder aspirating means thereby to vary the effectiveness of said powder aspirating means without materially varying the volume of gas flow.

21. Powder flame spraying apparatus as defined in claim 19 characterized in the provision of means for separating powder from said conveying gas before venting a portion of said gas to the atmosphere.

22. That method of applying a strip of hardfacing directly to an uncoated metallic body which comprises:

progressively flame-heating successive merging areas of said uncoated metallic body with a plurality of separate flames while advancing said metallic body and said flames past one another along substantially the shortest path between all of said flames lengthwise of the area undergoing hardfacing, said flames including a preheater flame and a plurality of other flames;

positioning said preheater flame ahead of said other flames to preheat successive merging areas of said metallic body to a temperature of approximately 900° F.

positioning said other flames opposite one another and generally normal to the area to be coated with hardfacing downstream from said preheater flame and so positioned that the adjacent sides of the flame envelopes thereof intersect one another; and dispensing hardfacing powder substantially at ambient temperature into the intersecting portions of the envelopes of said other flames and against the preheated area of said metallic body to form a strip of hardfacing on said metallic body.

23. That method defined in claim 22 characterized in the step of utilizing the merging portions of said other flame envelopes to concentrate the deposit of hardfacing to maximum thickness in an area between the thin feather lateral edges of said hardfacing.

24. That method defined in claim 23 characterized in the step of applying said hardfacing powder in an area embracing a corner of said metallic body while the merging corner surfaces of said metallic body are being heated to fusion temperature by a respective one of said other flames and depositing a maximum thickness of said powder about the corner of said body.

25. That method defined in claim 22 characterized in the steps of dispensing said hardfacing powder into said merging flame envelopes in a stream of inert powder conveying gas.

26. That method defined in claim 25 characterized in the steps of utilizing said inert powder conveying gas to aspirate hardfacing powder thereinto from a supply of said powder, and varying the rate of flow of said powder by regulating the pressure of a portion of said powder conveying gas at a point downstream from said powder aspirating means by venting varying quantities thereof to the atmosphere.

27. That method defined in claim 26 characterized in the step of selectively varying the rate of flow of powder into said inert gas downstream from the entry of powder into said inert gas steam by admitting atmospheric air into said inert gas stream and/or by venting gas to the atmosphere from said inert gas stream.

28. That method defined in claim 22 characterized in the steps of providing a source of hardfacing powder, utilizing a stream of pressurized gas to aspirate a flow of said powder from said source thereof for delivery into the envelopes of said other flames at substantially ambient temperature, and varying the rate of powder flow into said pressurized gas by venting atmospheric gas into said stream of said gas at a point closely adjacent the entry of said powder into said gas.

29. That method defined in claim 28 characterized in the step of selecting a rate of powder flow into said pressurized gas between maximum flow and zero flow while maintaining the gas pressure substantially uniform upstream from the point of entry of said powder thereinto and by regulating the superatmospheric pressure of the gas having powder admixed therewith by venting variable quantities thereof to the atmosphere.

30. That method defined in claim 22 characterized in the steps of providing a source of hardfacing powder, utilizing a stream of pressurized gas to aspirate powder from said source into said gas for discharge between the merging flame envelopes of said other flames, and varying the aspiration of powder into said gas by venting varying portions of said gas to the atmosphere to regulate the superatmospheric pressure of said gas after aspirating powder thereinto but before dispensing said powder and gas into said merging envelopes of said other flames.

31. That method of applying hardfacing directly to an uncoated metallic body which comprises:

progressively heating successive merging areas of said uncoated metallic body by a plurality of flames including a preheater flame and a plurality of final heater flames the latter of which have merging flame envelopes and are spaced upstream from said preheater flame and which plurality of flames cooperate to bring the metal surface to a temperature effective to fuse hardfacing powder thereto; and dispensing hardfacing powder at substantially ambient temperature into the merging flame envelopes of said final heater flames while advancing said flames and said metallic body past one another along substantially the shortest path between said progressively heated areas and at the rate at which said flames cooperate in bringing said progressively heated surface areas of said metallic body to a temperature to fuse said hardfacing powder thereto.

32. That method defined in claim 31 characterized in the step of aspirating said hardfacing powder into a stream of pressurized inert gas at ambient temperature and dispensing the same into the envelopes of said final heater flames in a path isolated from the fuel supporting said final heater flames.

33. That method defined in claim 32 characterized in the step of venting variable quantities of said pressurized inert gas to the atmosphere downstream from the entry of said powder thereinto thereby to vary the flow rate of said powder dispensed into said final heater flames.

34. That method defined in claim 32 characterized in the step of varying said inert gas pressure after said hardfacing powder has been aspirated thereinto by venting variable quantities of said pressurized gas to the atmosphere while the source pressure of said inert gas remains substantially constant.

35. That method of applying hardfacing directly to an uncoated metallic body which comprises:

utilizing a plurality of flames including at least a pair of converging flames each provided witn independently regulatable fuel supplies and having merging flame envelopes positioned and cooperating to heat the surface of said uncoated metallic body to a temperature to fuse hardfacing powder thereto;

utilizing a stream of inert gas from a pressurized source thereof to aspirate hardfacing powder thereinto from a supply source of said powder;

varying the flow rate of said powder by selectively varying the admission of air into gas in use to aspirate said powder and varying the release of said gas to the atmosphere downstream from the admixture of powder with said gas; and dispensing said intermixed powder and inert gas while substantially at ambient temperature into the merging flame envelopes of said pair of converging flames while moving said metallic body and said flames relative to one another thereby to fuse said powder to said metallic body.

* * * * *

UNITED STATES PATENT AND TRADEMARK OFFICE

CERTIFICATE OF CORRECTION

PATENT NO. : 4,411,935

DATED : October 25, 1983

INVENTOR(S) : JAMES Y. ANDERSON

It is certified that error appears in the above-identified patent and that said Letters Patent are hereby corrected as shown below:

Column 9, Claim 6, line 66, change "5" to -- 4 --

Column 12, Claim 28, line 32, change "gas" second occurrence to -- air --.

Signed and Sealed this

*Twenty-seventh* Day of *March 1984*

[SEAL]

*Attest:*

GERALD J. MOSSINGHOFF

*Attesting Officer*

*Commissioner of Patents and Trademarks*